United States Patent [19]

McKeon

[11] Patent Number: 4,969,420

[45] Date of Patent: Nov. 13, 1990

[54] MAGNESIUM PRESSURE VESSEL WATER TANK

[76] Inventor: R. Clayton McKeon, 153 N. Division, Holland, Mich. 49424

[21] Appl. No.: 357,667

[22] Filed: May 25, 1989

Related U.S. Application Data

[63] Continuation of Ser. No. 220,002, Jul. 15, 1988, abandoned.

[51] Int. Cl.[5] ..... F22B 5/04; F25J 3/02; B21K 29/00

[52] U.S. Cl. ..... 122/17; 122/14; 122/19; 122/44.2; 122/155.2; 29/890.051; 29/DIG. 27; 126/391; 220/3

[58] Field of Search ..... 29/DIG. 27, DIG. 13, 29/890.051, 455.1; 75/53, 58; 122/13 R, 14, 17, 44 A, 155 A, 210, , 234, DIG. 13; 126/204, 391, 392, 373, 400; 165/133; 220/3; 420/5, 402

[56] References Cited

U.S. PATENT DOCUMENTS

| | | | |
|---|---|---|---|
| 2,385,686 | 9/1946 | Busk | 420/402 |
| 2,459,123 | 1/1949 | Bates et al. | 29/DIG. 27 X |
| 2,823,996 | 2/1958 | Gardner | 420/402 |
| 2,866,742 | 12/1958 | Sutton | 122/13 R X |
| 2,874,683 | 2/1959 | La Rue | 122/17 |
| 3,465,123 | 9/1969 | Harris | 122/13 R |
| 3,492,972 | 2/1970 | McLaren | 122/17 |
| 3,884,216 | 5/1975 | McCartney | 126/204 |
| 4,116,016 | 9/1978 | Roop et al. | 165/133 X |
| 4,244,350 | 1/1981 | Chubb | 126/400 |
| 4,505,231 | 3/1985 | Syler | 122/159 |
| 4,510,890 | 4/1985 | Cowan | 122/17 |
| 4,522,190 | 6/1985 | Kuhn et al. | 420/402 |
| 4,705,664 | 11/1987 | Haigh | 75/58 X |
| 4,766,883 | 8/1988 | Cameron et al. | 122/17 X |

OTHER PUBLICATIONS

"Magnesium Sheet Easily Formed . . . ", Harvey et al., American Machinist, pp. 105-108, May 25, 1944.

"Fabricating Methods for Magnesium Alloys", Product Engineering, pp. 568-575, Sep. 1943.

*Primary Examiner*—Timothy V. Eley
*Assistant Examiner*—Peter Dungba Vo
*Attorney, Agent, or Firm*—Flynn, Thiel, Boutell & Tanis

[57] ABSTRACT

This invention pertains to a magnesium water heater and a method of fabricating the same. The magnesium water heater of the present invention can be heated by an electric resistance element or a gas burner and has advantages over prior art water heaters in that it can be more easily fabricated, it is lighter in weight, and has a service life of 4 to 10 times longer than conventional water tanks due to improved corrosion resistance.

5 Claims, 2 Drawing Sheets

MAGNESIUM PRESSURE VESSEL WATER TANK

This application is a continuation of U.S. Ser. No. 07/220 002, filed July 15, 1988 now abandoned.

BACKGROUND OF THE INVENTION

Traditional water heater tanks are steel tanks lined with glass or are made of some suitable plastic or fiberglass material. These glass lined steel water heater tanks are typically formed in complicated manufacturing processes where the heads, bases and tank shells are formed separately, the heads are press-fitted in and welded to the tank shells, glass enamel applied to the tank shell and head as a bisque and then baked at a temperature of from 1600° to 1750° F. in order to melt the glass and coat the steel. Enamel is then applied to the base and the base is pressed into the shell and welded thereto.

However, during the welding of the base to the shell, the glass lining typically reflows and deposits glass in the weld between the shell and the base which reduces the amount of glass coating at the seam formed by the juncture of the base and the shell and weakens the weld. Because of these problems, these water heater tanks typically fail along the juncture formed by the shell and the base because of the reduced protection of the thinner glass lining at this point and because the weld joining the shell and the base is generally weaker than the other welds in the water heater tank because of the glass contained therein.

Attempts to combat corrosion in these typical glass lined steel heater tanks have included the placing of a sacrificial magnesium anode within the tank in order that the magnesium anode would dissolve and coat any exposed steel surface in the tank with a magnesium oxide coating. However, this method of preventing corrosion has had problems in that the steel in the water heater tank may be attacked by the water and chemicals contained in the water before an adequate protective coating of magnesium oxide is formed thereon. Another problem is that the amount of protection available for any exposed steel surface is dependent on the amount of magnesium used as a sacrificial anode. After the sacrificial anode is consumed, there is no protection available for any subsequently exposed steel surfaces.

Plastic or fiberglass water heater tanks do not have the problems of corrosion that are commonly found in glass lined steel water heater tanks but are not capable of being gas-fired because of the temperature limitations associated with the materials of their construction and involve complicated molding procedures in their fabrication.

Therefore, the need exists for a water heater tank that can be easily fabricated, provides maximum corrosion protection and is flexible enough to employ various heating elements such as a gas burner or electrical resistance heating elements as the means of heating the water.

SUMMARY OF THE INVENTION

Accordingly, it is a principle object of the present invention to provide a water heater tank that can be more easily manufactured than conventional glass lined steel water heater tanks.

It is another object of the present invention to provide a water heater tank which has an extended service life, due to improved corrosion protection, than conventional water heater tanks found on the market.

It is a further object of the present invention to provide a water heater tank having improved corrosion resistance and the flexibility to be able to utilize different types of heating elements such as a gas burner or an electric resistance heating element.

It is a further object of the present invention to provide a method for making a water heater tank according to the present invention.

In accordance with the present invention, there is provided a magnesium pressure vessel comprising a tank having a cylindrical magnesium shell, a dome-shaped magnesium head having a concave surface welded to one end of the cylindrical shell, and a dome-shaped magnesium base having a concave surface welded to the other end of the cylindrical shell in such a manner that the dome-shaped head and the dome-shaped base are disposed in face-to-face relationship.

In further accordance with the present invention, there is provided a magnesium water heater tank comprising a tank having a cylindrical magnesium shell, a dome-shaped magnesium head having a concave surface welded to one end of the cylindrical shell, a dome-shaped magnesium base having a concave surface welded to the other end of the cylindrical shell in such a manner that the concave surfaces of the dome-shaped head and the dome-shaped base are disposed in face-to-face relationship, means to introduce water to be heated within the tank, means to withdraw the heated water from the tank and heat exchanger means located within the tank to transfer heat to the water contained within the tank and a method for assembling this magnesium water heater tank.

BRIEF DESCRIPTION OF THE DRAWINGS

The above and other objects and features of the invention will be apparent from the description of the preferred embodiments taken with reference to the accompanying drawings in which.

DETAILED DESCRIPTION OF THE INVENTION

Figure 1:
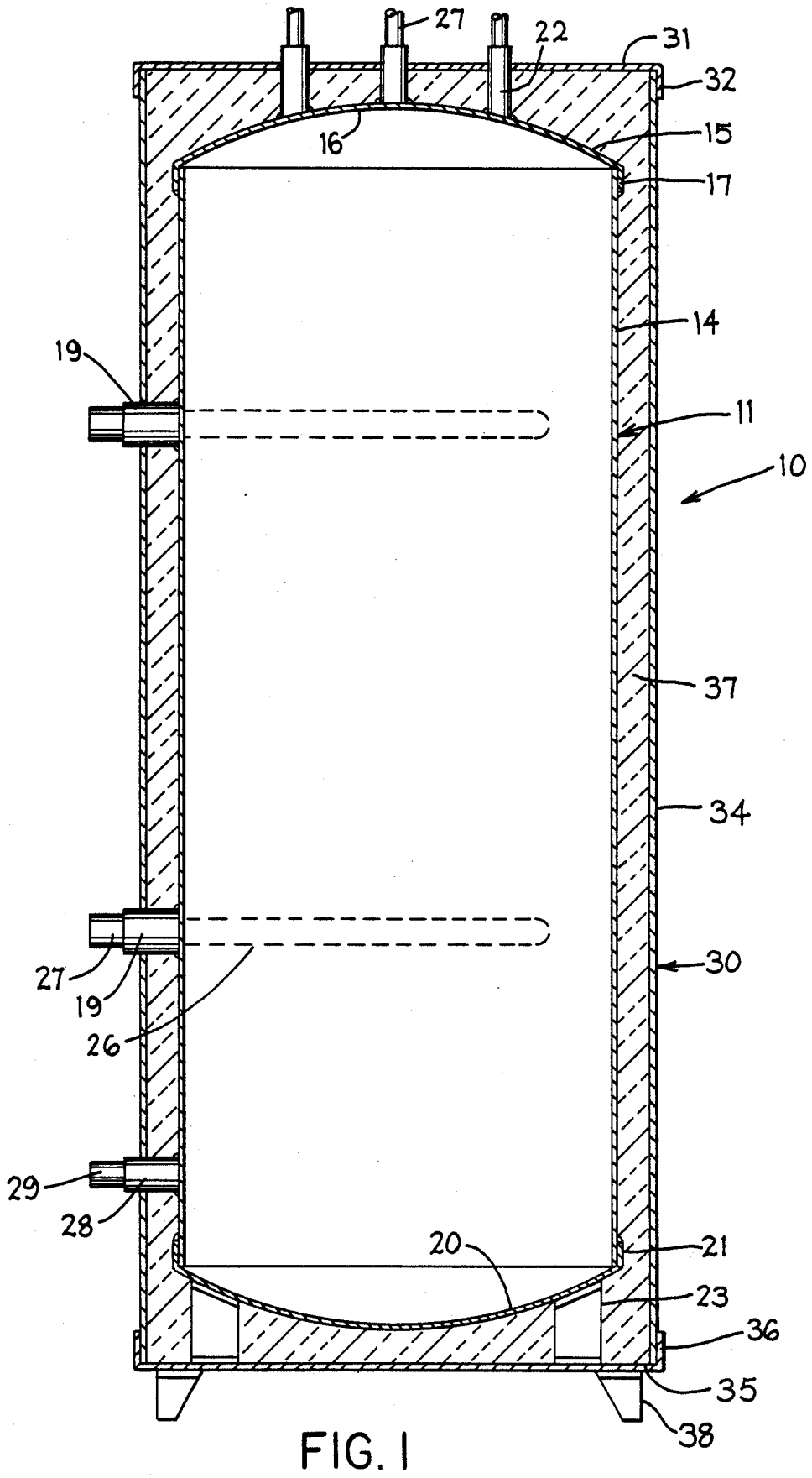
FIG. 1 is a cross sectional view of a magnesium water heater tank employing electric resistance heating elements.

FIG. 1 shows a water heater unit 10 comprising a magnesium water heater 11 contained in a water heater unit outer shell 30. The magnesium water heater 11 comprises a magnesium cylindrical shell 14, a dome-shaped head 15 having a concave surface 16 and a circumferential lip 17 extending around and outward from the concave surface 16, and a dome-shaped base 20 having a concave surface 20 and a circumferential lip 21 extending around and outward from the concave surface 20. The dome-shaped head 15 and the dome-shaped base 20 are both made of magnesium and the magnesium cylindrical shell 14 is slip-fitted inside the circumferential lips 17, 21 of the dome-shaped head 15 and the dome-shaped base 20 and welded thereto.

Magnesium pipe fittings 22 are provided over openings provided in the dome-shaped head 15 and are welded thereto. Non-metallic nipples 27 are inserted in the magnesium pipe fittings 22 and provide a means for ingress and egress of water into and out of the magnesium water heater 11. One of the non-metallic nipples 27 may contain a suitable pressure release device (not illustrated) designed to maintain the water heater unit 10 at a desired pressure. The nipples 27 are made of a non-metallic material in order to prevent anodic corrosion between them and the magnesium pipe fittings 22.

The magnesium cylindrical shell 14 also contains magnesium pipe fittings 19 and 28 positioned over openings provided in the magnesium shell 14 and are welded thereto. Electric resistance heating elements 26 are introduced into the magnesium water heater 11 through the magnesium pipe fittings 19. These electric resistance heating elements 26 are connected to the magnesium pipe fittings 19 by way of non-metallic nipples 27. The nipples 27 are made of a non-metallic material in order to avoid anodic corrosion between them and the magnesium pipe fittings 19. Another magnesium pipe fitting 28 is provided over an opening contained in a lower portion of the magnesium cylindrical shell 14 and is welded thereto and serves as a means by which water is drained from the magnesium water heater 11. A non-metallic nipple 29 is connected to the magnesium pipe fitting 28 and serves as a conduit through which the drained water is transported to a desired location. The non-metallic nipple 29 is provided in the magnesium pipe fitting 28 in order to avoid anodic corrosion between the nipple 29 and the pipe fitting 28.

Magnesium legs 23 are welded to the dome-shaped base 20 and provide the means for supporting the magnesium water heater 11 within the water heater unit outer shell 30.

The water heater unit outer shell 30 comprises a cylindrical shell body 34, a flat, circular shell head 31 having a circumferential lip 32 and a flat, circular shell base 35 having a circumferential lip 36. The water heater unit outer cylindrical shell body 34 is fitted inside the circumferential lips 32 and 36 of the shell head 31 and the shell base 35 and adhered thereto in a suitable fashion. The water heater unit outer shell 30 can be made of any suitable material, such as a metal or a plastic, for the environment in which the water heater unit 10 is utilized. Openings are provided in the shell head 31 and the outer shell cylindrical body 34 in order to enable the egress of the magnesium pipe fittings 19, 22 and 28 provided on the magnesium water heater 11. Insulation 37 is provided between the magnesium water heater 11 and the water heater unit outer shell 30 in order to reduce the loss of heat from the magnesium water heater 11 to the environment. Legs 38 are provided on the shell base 35 and constitute the means for supporting the water heater unit 10.

Figure 2:
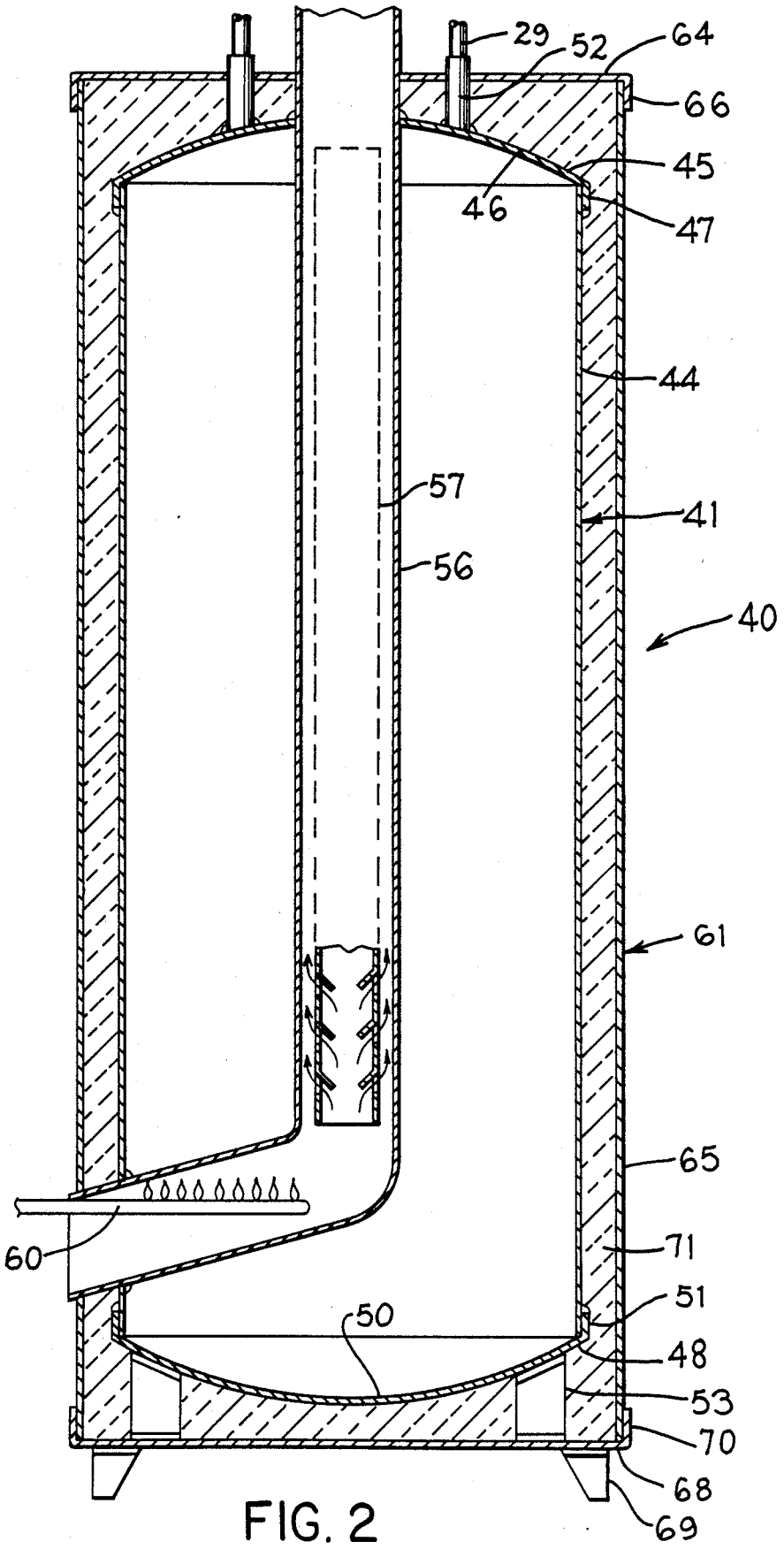
FIG. 2 is a cross sectional view of a magnesium water heater tank utilizing a gas burner.

Another embodiment of the present invention is shown in FIG. 2. The water heater unit 40 shown in FIG. 2 comprises a water heater unit outer shell 61 containing therein a magnesium water heater 41 having a magnesium cylindrical shell 44, a magnesium dome-shaped head 45 having a concave surface 46 and a circumferential lip 47 extending around and outward from the concave surface 46 and a magnesium dome-shaped base 48 having a concave surface 50 and a circumferential lip 51 extending around and outward from the concave surface 50. The magnesium cylindrical shell 44 is slip-fitted inside the circumferential lips 47 and 51 of the dome-shaped head 45 and the dome-shaped base 48 and welded thereto. The dome-shaped head 45 and the dome-shaped base 48 are positioned on the cylindrical shell 44 in such a fashion that the concave surfaces 46 and 50 face each other.

A large opening and two smaller openings are provided in the dome-shaped head 45. An opening is also provided in a lower section of the cylindrical shell 44. Magnesium pipe fittings 52 are provided over the smaller openings in the dome-shaped head 45 and are welded thereto. Non-metallic nipples 29 are provided in the magnesium pipe fittings 52 and serve as a means for ingress and egress of water to and from the magnesium water heater 41. The nipples 29 are made of a non-metallic material in order to avoid anodic corrosion between them and the magnesium pipe fittings 52.

A magnesium flue tube 56 is contained within the magnesium water heater 41 and enters the magnesium water heater 41 at the opening provided in the lower section of the cylindrical shell 44 and exits the water heater 41 through the large opening provided in the dome-shaped head 45. The outer diameter of the upper section of the flue tube 56 exiting the magnesium water heater 41 is approximately equal to the diameter of the large opening provided in the dome-shaped head 45 and the outer diameter of a lower section of the flue tube 56 is approximately equal to the diameter of the opening provided in the lower section of the cylindrical shell 44. The upper section of the flue tube 56 is welded to the dome-shaped head 45 in such a fashion that a seal is formed between the flue tube 56 and the dome-shaped head 45. The lower section of the flue tube 56 is welded to the cylindrical shell 44 in such a fashion that a seal is also formed between the flue tube 56 and the cylindrical shell 44. A gas burner 60 is provided in a lower section of the flue tube 56 in order to generate heat in the flue tube 56 that is transferred from the flue tube 56 to the water contained in the magnesium water heater 41. Baffling means such as a magnesium baffle 57 or fins or ribs (not illustrated) is contained in a vertically disposed section of the flue tube 56 and serves as a means for causing turbulence in the heated air and evenly distributing the heat generated in the flue tube 56 by the gas burner 60. Magnesium legs 53 are welded to the dome-shaped base 48 and provide the means for support of the magnesium water heater inside the water heater unit outer shell 61.

The water heater unit outer shell 61 comprises a shell head 64, a cylindrical shell body 65 and a shell base 68. The shell head 64 is a circular, flat member having a circumferentially extending lip 66 and the shell base 68 is a flat, circular member having a circumferentially extending lip 70. The outer shell cylindrical body 65 is fitted in and adhered to the circumferentially extending lips 66 and 70 of the outer shell head 64 and the outer shell base 68 by any suitable means. The water heater unit outer shell 61 can be made of any suitable material, such as a metal or a plastic, depending on the environment the water heater unit 40 is utilized in. Openings are provided in the shell head 64 and the outer shell cylindrical body 65 in order to allow the egress of magnesium pipe fittings 52 and the flue tube 56 of the magnesium water heater 41. Legs 69 are provided on the outer shell base 68 and constitute the means for support of the water heater unit 40.

The magnesium water heater tanks of the present invention have advantages over the water heater tanks of the prior art in that they are easier to fabricate, have a much lighter weight and have a much higher service life because of their corrosion resistance. With the water heater tanks of the present invention, the steps of providing a glass lining inside the tank and fabricating a separate head and base of the cylindrical shell body can be dispensed with.

In traditional glass lined water heater tanks, it is necessary that the base for the water heater tank be installed in such a fashion that the concave surface of the base is facing down. This is necessary because the base is press-fitted into the shell by a machine as opposed to the present invention where the shell is slip-fitted inside the base by hand and the base welded to the shell in this position. The elimination of the step of machine press-fitting in the present invention results in a much simpler and economical fabrication process.

Also, since magnesium has one-fourth the weight of steel, the magnesium water tanks of the present invention can be more easily located in a building structure or dwelling without regard to its weight. Furthermore, because of the corrosion resistance properties of magnesium as compared to steel, the water heater tanks of the present invention have service lives of 4 to 10 times that of conventional glass lined steel tanks.

Gas heat may also be used with the water heater tanks of the present invention without concern for the deformation of plastic or fiberglass in a plastic or fiberglass water heater tank. The 4 to 10 times increase in service life, the ease of fabrication, the weight reduction and the ability to use gas heat with the present tanks are unexpected advantages gained by using magnesium as a material of construction for the present water tanks.

The magnesium water tanks of the present invention are fabricated in the following manner. Although the discussion that follows refers to magnesium, it should be understood that magnesium alloys containing up to 10% by weight aluminum, 4% by weight zinc, 0.75% by weight zirconium, 4.25% by weight thorium and 2.0% by weight manganese can be used in the present invention. A particularly preferable magnesium alloy is AZ31B and is available from Dow Chemical. This alloy consists essentially of 3% by weight aluminum, 1% by weight zinc, 0.2% by weight manganese and the balance being magnesium.

All of the following welding steps are performed with an electrode consisting essentially of tungsten and in an inert gas atmosphere such as argon, helium and mixtures thereof. This welding method seems to achieve the strongest welds in the present invention which is unexpected in that thoriated tungsten electrodes are typically used to weld magnesium.

The magnesium water heater of FIG. 1 is fabricated as follows. A plurality of openings is punched into a first magnesium sheet. This first magnesium sheet is then hot-rolled at a temperature of about 500° F. and formed into a cylindrical shell having a seam. The seam is then welded using an electrode consisting essentially of tungsten in an inert gas atmosphere.

A plurality of openings is then punched into a second sheet of magnesium and this second sheet of magnesium then formed into a first dome-shaped member having a concave surface and a circumferential lip extending around and outward from the concave surface by hot working at a temperature of approximately 500° F. A third sheet of magnesium is then hot-formed at a temperature of approximately 500° F. into a second dome-shaped member having a concave surface and a circumferential lip extending around and outward from the concave surface.

Magnesium pipe fittings are then provided over the openings in the cylindrical shell and the first dome-shaped member and welded thereto by again using an electrode consisting essentially of tungsten in an inert gas atmosphere. One end of the cylindrical shell is then slip-fitted inside the circumferential lip of the first dome-shaped member and welded thereto using the same welding method discussed above. The other end of the cylindrical shell is then slip-fitted inside the circumferential lip of the second dome-shaped member and welded thereto using the above-discussed welding method.

The thus formed magnesium water heater is then stress relieved by being heated at a temperature of up to 500° F. for about 15 minutes in order to relieve any stress that may have formed in the magnesium during the welding operations. An insulating material and the outer shell is then formed around the magnesium water heater and electric resistance heating elements are then inserted through the cylindrical shell into the magnesium water heater by way of non-metallic nipples engaged with the magnesium pipe fittings. Non-metallic nipples also engage with the magnesium pipe fittings welded to the head of the magnesium water tank and provides the means for ingress and egress of water to and from the tank.

The fabrication of the magnesium water heater shown in FIG. 2 is identical to the previously discussed fabrication of the water heater shown in FIG. 1 with the exception of the provision of a magnesium flue tube in the second water heater and the welding of the flue tube to the head and the cylindrical shell of the magnesium water heater in such a fashion that pressure tight seals are formed. After the welding of the flue tube to the magnesium water heater, the entire structure is then heat relieved at 500° F. for approximately 15 minutes and then installed in an outer shell provided around the magnesium water heater as discussed above. A° gas burner is then provided in a lower portion of the flue tube and means to introduce water into and out of the magnesium water heater is connected to non-metallic nipples engaging with the magnesium pipe fittings welded to the head of the water heater.

Although tungsten inert gas welding is preferred in the present invention, other welding methods such as laser welding may be used. Welding filler rods can be varied according to the composition of the magnesium water tank and are selected to achieve the strongest welds.

Although preferred embodiments of the invention has been illustrated and described with reference to the accompanying drawings, it will be understood to those skilled in the art that the preferred embodiments are by way of example and that various changes and modifications may be made without departing from the spirit and scope of the invention, which is intended to be defined by the appended claims.

The embodiments of the invention in which an exclusive property or privilege is claimed are defined as follows:

1. A magnesium water heater comprising: a tank having a magnesium shell, a magnesium head affixed to one end of said shell; a magnesium base affixed to the other end of said shell; means for introducing water to be heated within said tank; means for withdrawing heated water from said tank; and heat exchanger means for transferring heat to water contained within said tank.

2. A magnesium water heater comprising: a tank having a cylindrical magnesium shell; a dome-shaped magnesium head having a concave surface welded to one end of said cylindrical shell; a dome-shaped magnesium base having a concave surface welded to the other end of said cylindrical shell, said concave surfaces of said dome-shaped head and said dome-shaped base being disposed in face to face relationship; means for introducing water to be heated within said tank; means for withdrawing heated water from said tank; and heat exchanger means located within said tank for transferring heat to water contained within said tank.

3. The magnesium water heater of claim 2, additionally comprising magnesium flue tube means positioned within said tank, said flue tube means entering said tank at a lower section of said cylindrical shell and exiting said tank through said dome-shaped head and having baffle means disposed therein; and gas burner means located in a lower section of said flue tube for heating said flue tube and thereby transfer heat to water contained within said tank and surrounding said flue tube.

4. A magnesium water heater comprising: a tank having a magnesium shell; a magnesium head welded to one end of said shell; a magnesium base welded to the other end of said shell; means for introducing water to be heated within said tank; means for withdrawing heated water from said tank; and heat exchanger means located within said tank for transferring heat to water contained within said tank.

5. The magnesium water heater of claim 4, additionally comprising magnesium flue tube means positioned within said tank, said flue tube means entering said tank at a lower section of said shell and exiting said tank through said head and having baffle means disposed therein; and gas burner means located in a lower section of said flue tube for heating said flue tube and thereby transfer heat to water contained within said tank and surrounding said flue tube.

* * * * *